United States Patent [19]

Wade et al.

[11] 4,167,155

[45] Sep. 11, 1979

[54] AUTOMATIC ANIMAL HEADGATE WITH BOTTOM HINGED GATES

[76] Inventors: Jerry D. Wade, Rte. #2, Box 76; Phillip H. Geisler, Rte. #1, Box 40, both of Galena, Kans. 66739

[21] Appl. No.: 825,851

[22] Filed: Aug. 18, 1977

Related U.S. Application Data

[63] Continuation-in-part of Ser. No. 718,037, Aug. 26, 1976, Pat. No. 4,100,886.

[51] Int. Cl.[2] ..... A61D 3/00

[52] U.S. Cl. ..... 119/98

[58] Field of Search ..... 119/98, 99, 103, 147

[56] References Cited

U.S. PATENT DOCUMENTS

| | | | |
|---|---|---|---|
| 2,587,160 | 2/1952 | Howe | 119/99 |
| 3,043,269 | 7/1962 | Kausche | 119/98 |
| 3,511,216 | 5/1970 | George | 119/147 |
| 3,538,890 | 11/1970 | Torell | 119/98 |
| 3,788,280 | 1/1974 | Van Gilst | 119/99 |

*Primary Examiner*—Louis G. Mancene
*Assistant Examiner*—Robert P. Swiatek
*Attorney, Agent, or Firm*—Clarence A. O'Brien; Harvey B. Jacobson

[57] ABSTRACT

The bottom hinged stanchion posts of an animal headgate are displaced from a closed position to an open position by an actuator lever after one of a pair of oppositely engaging one-way locking elements is manually released from engagement with a common lock rod connected to one of the gate posts. An opening pressure applied to the posts in the open position releases the engaged locking element to permit the gate to close under a spring bias applied through the actuator lever.

9 Claims, 6 Drawing Figures

56
60
46
22
86
81
64
70
72
90
48
80
88
84
78
74
76
40
82
66
54
68
52
42
44
16
26

46
22
81
64
90
88
78
86
80
68
66
54

6
22
64
70
90
48
88
78
76
80
74
42
68
40
66
82
54
46
52
16
6
44

AUTOMATIC ANIMAL HEADGATE WITH BOTTOM HINGED GATES

BACKGROUND OF THE INVENTION

This invention relates in general to automatic headgates for restraining animals of the type disclosed in our prior copending application, Ser. No. 718,037, filed Aug. 26, 1976 (now U.S. Pat. No. 4,100,886), with respect to which the present application is a continuation-in-part.

The headgate device featured in our prior copending application includes a rectangular frame in which a pair of folding panel gates are mounted for displacement from a closed position to an open position by a trigger lever through a linkage arrangement which elastically deforms a spring thereby rendered operative to exert a closing bias on the gates when in the open position. The gates are thus closed under this bias upon release of a pair of one-way locking devices. The engaged locking devices are both automatically released in response to an opening pressure applied to the gates in the open position by an animal attempting to pass therethrough. The locking devices also lock the gates against opening from the closed position and are manually released to permit opening of the gates by the trigger lever.

The locking devices act together but independently of each other on the respective gates according to my prior copending application, aforementioned, through separate lock rods connected to the gate posts. Automatic release of both locking devices at the same time is therefore dependent upon the linkage interconnection between the gates while an additional connecting linkage is required in order to effect simultaneous release of both locking devices under manual control, in the closed position of the gates.

It is, therefore, an important object of the present invention to provide an improved one-way locking arrangement for automatic headgates of the type disclosed in my prior copending application, aforementioned, by reducing the number of parts and enhancing operational reliability. An additional object is to provide an automatic headgate of the bottom hinged type with the aforementioned improved one-way releasable locking arrangement.

PRIOR ART STATEMENT

Except for the prior art made of record by applicants and the Examiner in the prior copending application, aforementioned, applicants are not now aware of any other pertinent prior art.

SUMMARY OF THE INVENTION

In accordance with the present invention, a pair of bottom hinged gates are interconnected by links to an actuator lever for pivotal displacement to an open position in which a spring is elastically elongated so as to exert a heavy closing bias on the gates. A common lock rod is connected to one of the gate posts and is engageable with a pair of oppositely engaging one-way locking or gripping elements that are biased into locking engagement with the lock rod by frame anchored springs. A spacer projection on one of the locking elements insures that the elements are angularly spaced apart along the lock rod so that only one locking element is engaged while the other is released. One of the locking elements is pivotally mounted by the frame to lock the gates against movement to the open position and must be manually displaced to a release position before the gates are opened by the actuator lever. When the gates are opened, the other of the locking elements, which is floatingly mounted on the lock rod, will hold the gates against movement to the closed position. However, said other of the locking elements will be released in response to an opening pressure applied to the opened gates tending to displace the lock rod in a release direction with respect to the floatingly mounted locking element. Thus, the gates will automatically close under the spring closing bias when an animal attempts to pass through the opened gates.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF A PREFERRED EMBODIMENT

Figure 1:
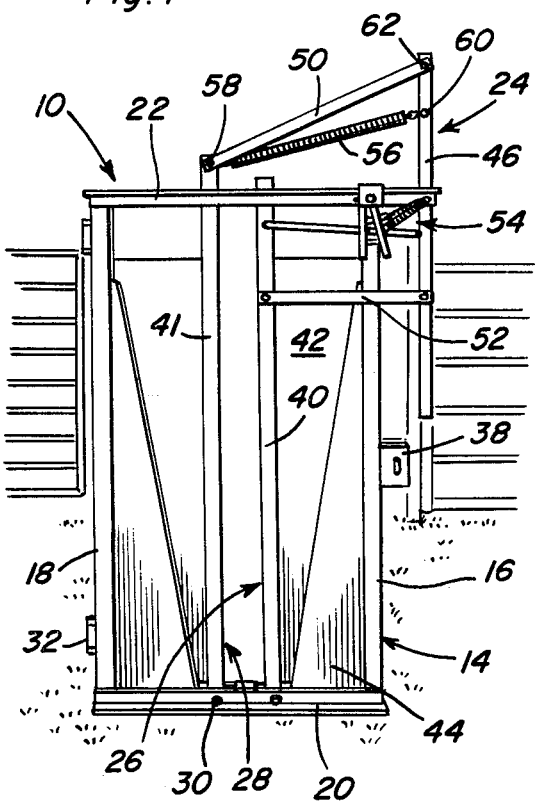
FIG. 1 is a front elevation view of a headgate assembly, constructed in accordance with the present invention, in a closed position.
Figure 2:
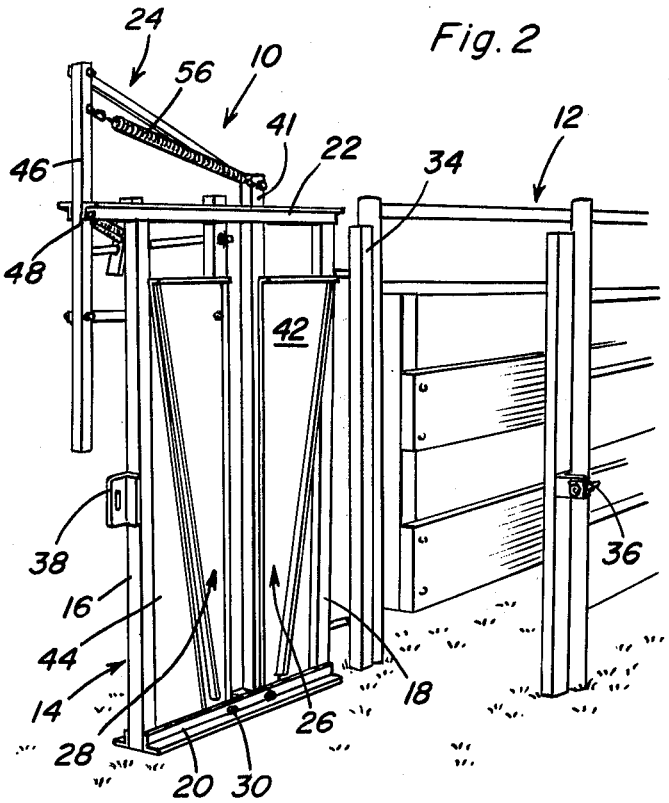
FIG. 2 is a perspective view showing the headgate assembly swung open relative to a walk-through passage structure.

Referring now to the drawings in detail, FIG. 1 illustrates the headgate assembly of the present invention generally referred to by reference numeral 10 installed at the exit end of a cattle walk-through passage structure 12 more clearly seen in FIG. 2. The headgate assembly includes a rigid, generally rectangular frame 14 assembled from a pair of vertical frame posts 16 and 18 interconnected at the bottom by a pair of bars 20 of L-shaped cross section to form a base and by a pair of bars 22 at the upper ends of the posts to form a lintel. The lintel bars 22 extend horizontally beyond the post 16 to support a force-applying actuator mechanism generally denoted by reference numeral 24. By means of the mechanism 24, a pair of gates 26 and 28 pivotally connected to the base 20 by spaced hinges 30 are displaced from the closed position shown in FIG. 1 to the open position shown in FIG. 3. When it is desired to permit exit of large animals from the passage 12, the entire headgate assembly is swung open as shown in FIG. 2. Thus, the vertical frame post 18 is connected by hinges 32 to one of the mounting posts 34, the other mounting post having a latch device 36 thereon for releasable engagement with a latch bar 38 mounted on frame post 16.

Figure 3:
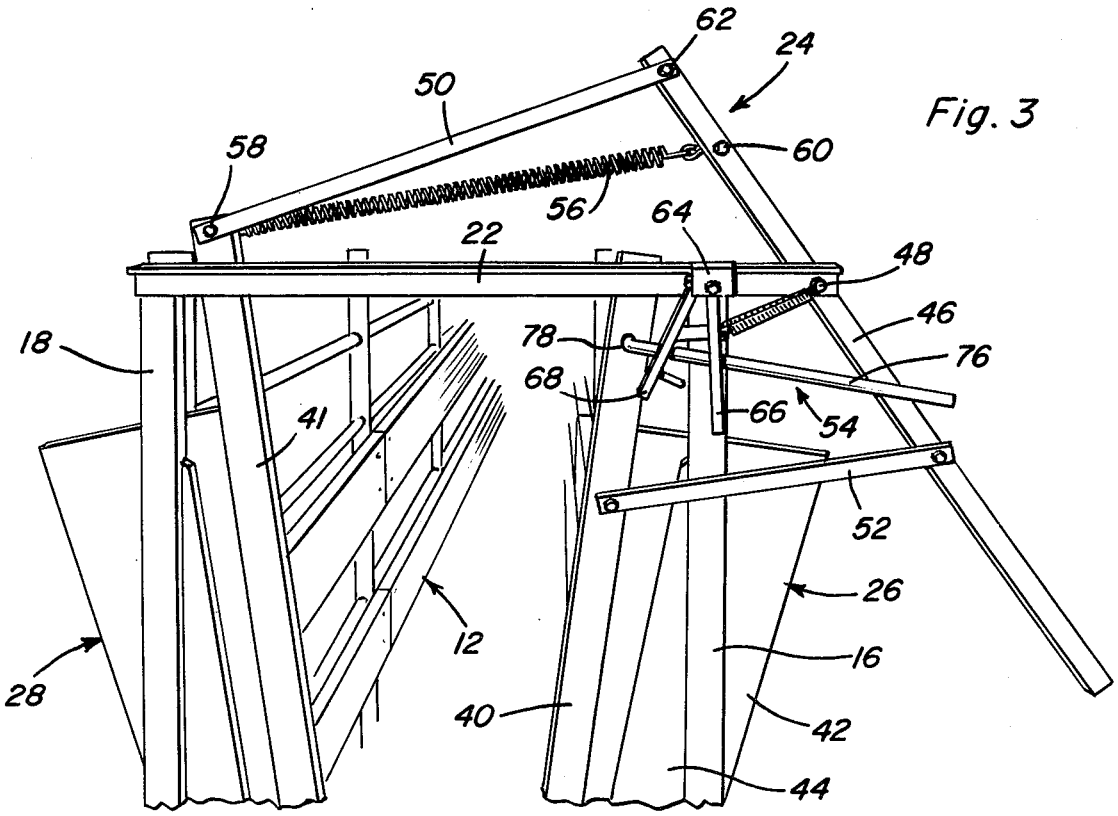
FIG. 3 is a partial perspective view showing the headgate assembly in an open position.

As more clearly seen in FIG. 3, the gates 26 and 28 are constructed of adjacent stanchion posts 40 and 41 to which gate panels 42 are secured. The gate panels are movable with the posts in sliding relation to triangular guide panels 44 fixed to the frame. The posts 40 and 41 project between and above the lintel bars 22 for guided pivotal movement, the post 41 being slightly longer than the post 40.

The actuator mechanism 24 includes a lever 46 pivotally connected intermediate its ends to the frame by pivot assembly 48 interconnecting the ends of the lintel bars 22 in laterally spaced relation to the frame post 16. The upper end of the lever 46 is connected by link 50 to the upper end of gate post 41. A link 52 connected to the lever 46 below pivot 48 is connected to the other post 40 spaced below its upper end. The linkage arrangement formed by lever 46 and links 50 and 52 is such as to effect simultaneous pivotal movement of the gates 26 and 28 in opposite directions by equal amounts between the open and closed positions. In both of these positions, the gates will be held releasably locked by a locking mechanism generally referred to by reference numeral 54. The locking mechanism is manually released to permit the gates to be displaced to the open position by actuator lever 46 being swung in a counterclockwise direction as viewed in FIGS. 1 and 3. A heavy coil spring 56 is interconnected between the pivotal connection 58 at the upper end of gate post 41 and anchor 60 on the lever 46 below the upper pivot connection 62 to which link 50 is connected. The spring 56 is elastically elongated when the lever 46 is in its actuated position corresponding to the open position of the gates so as to then exert a relatively heavy closing bias on the gates.

Figure 4:
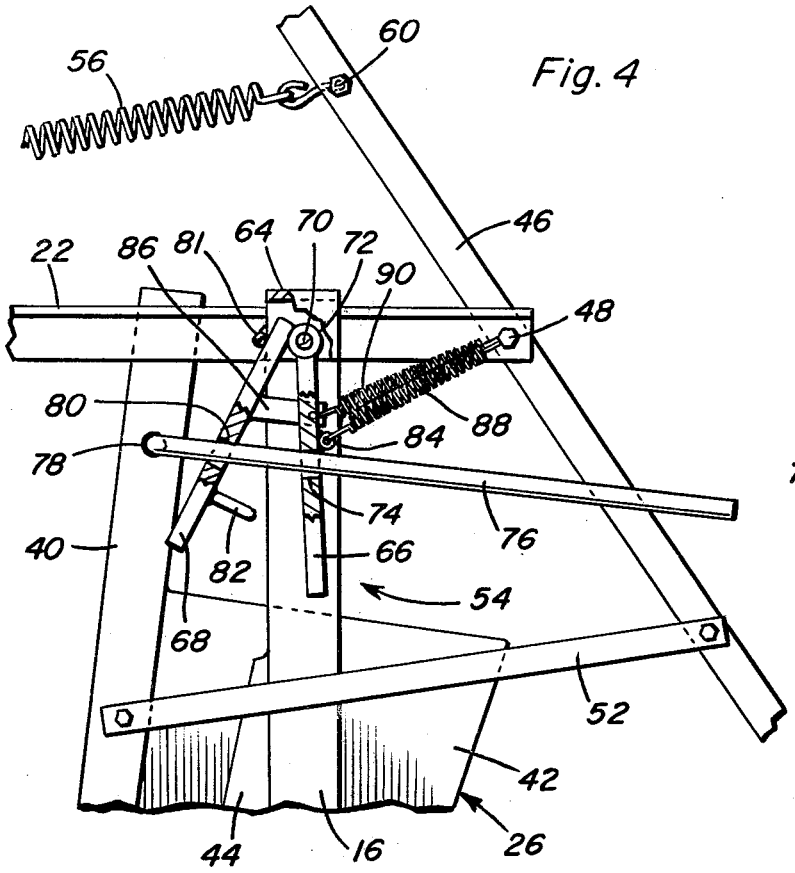
FIG. 4 is an enlarged partial front elevation view showing the headgate assembly in the open position with parts broken away and shown in section.
Figure 6:
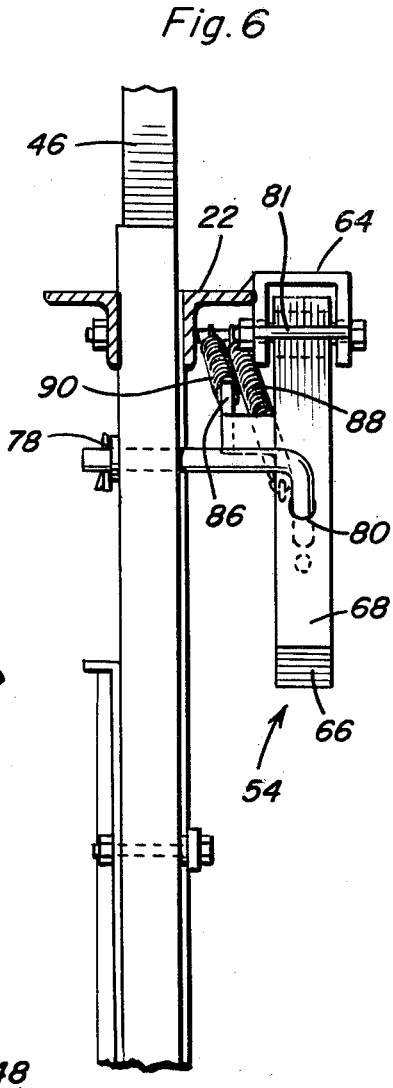
FIG. 6 is a partial section view taken substantially through a plane indicated by section line 6—6 in FIG. 5.

Referring now to FIGS. 4 and 6 in particular, the locking mechanism 54 includes a mounting bracket 64 from which a pair of one-way locking elements 66 and 68 depend on one side of the lintel bars 22 to which the bracket is secured. The locking element 66 includes a sleeve portion 72 at its upper end for pivotal mounting of the element in the bracket by means of pin 70. An opening 74 is formed in the element 66 slightly larger in diameter than a lock rod 76 extending therethrough. The lock rod is pivotally connected to the gate post 40 at 78 and also extends through an opening 80 of slightly larger diameter formed in locking element 68. The locking element 68 is floatingly mounted on the lock rod and confined at its upper end within bracket 64 by rod 81. A spacer formation 82 projects from element 68 toward element 66 and is thereby arranged to limit the spacing between the locking elements along the lock rod. Spring anchor tabs 84 and 86 project from the locking elements, to which coil springs 88 and 90 are connected. The springs 88 and 90 are anchored at ends opposite the locking element to the pviot connection 48.

Figure 5:
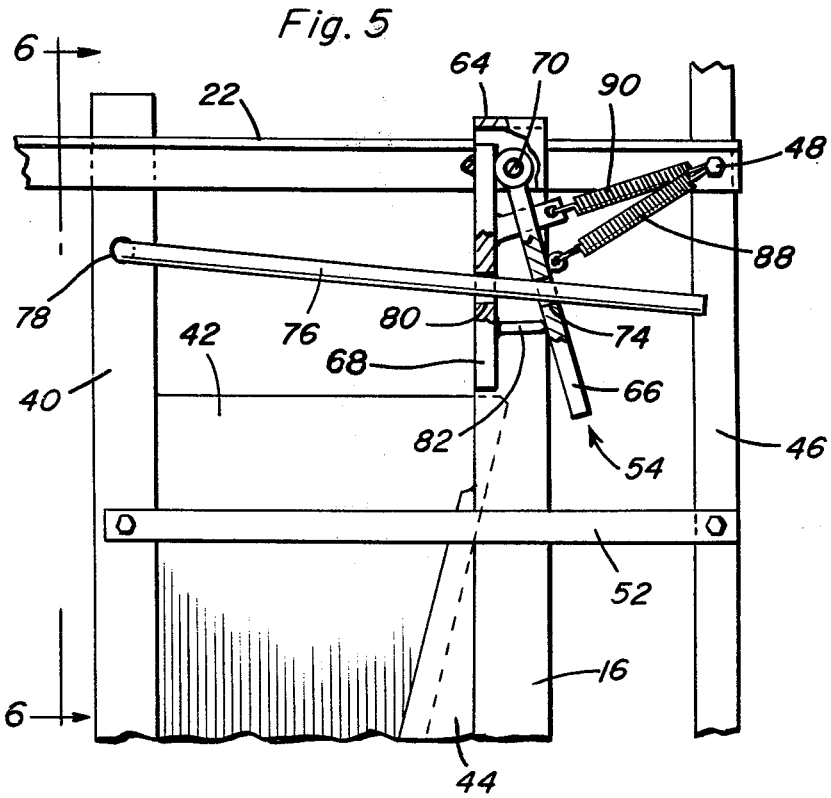
FIG. 5 is a section view similar to FIG. 4 but showing the headgate assembly in a closed position.

In the closed position of the gates as shown in FIG. 5, the spring 88 yieldably holds the locking element 66 at an angle to the lock rod 76 for one-way locking engagement in opening 74. Any force applied to post 40 in an opening direction tends to displace lock rod 76 to the right as viewed in FIG. 5 increasing the gripping engagement of the rod by element 66 to prevent opening movement. Locking element 68 in this engaged position of element 66 is held released by spacer 82 as shown. To release the locking mechanism, the element 66 is manually displaced in a clockwise direction as viewed in FIG. 5. The gates may then be opened by means of lever 46 as aforementioned.

In the open position of the gates, the closing bias of spring 56 tends to displace lock rod 76 in a leftward direction as viewed in FIG. 4 causing locking element 66 to release by clockwise displacement about its pivot 70. At the same time, locking element 68 is pivotally displaced clockwise into locking engagement as shown against the bias of its spring 90 to prevent closing movement of the gates. Should any opening pressure be applied to the gates, tending to displace lock rod 76 to the right as viewed in FIG. 4, then locking element 68 will be released to permit the heavy closing bias of spring 56 to snap the gates closed. Thus, closing of the gates occurs in response to the opening pressure applied to stanchion posts 40 and 41 by an animal attempting to pass between the open gates. The stanchion posts will therefore engage animals of all sizes and lock in any closed position under the action of the locking mechanism 54 as hereinbefore described, without any size adjustment. The animal is simply released by opening movement of the actuator lever 46 following manual release of locking element 66, to thereby also reset the locking mechanism 54 for automatic release by gate opening pressure as aforementioned.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An automatic headgate for animals, comprising a rigid frame, gate means mounted on the frame for displacement between an open position and a closed position, force-applying means rendered operative in the open position of the gate means for biasing the gate means to the closed position, a pair of releasable lock devices for respectively preventing displacement of the gate means from each of said open and closed positions, and means responsive to opening pressure applied to the gate means in the open position thereof for releasing one of the lock devices to permit closing of the gate means under the bias of the force-applying means.

2. The combination of claim 1, wherein said gate means includes a pair of gate posts pivotally mounted on the frame, said force-applying means including an actuating lever pivotally mounted on the frame, a pair of links connecting the lever to the gate posts, respectively, and spring means elastically deformed in response to displacement of the gate posts to the open position by the lever for exerting said closing bias on the gate means.

3. An automatic headgate for animals, comprising a rigid frame, gate means mounted on the frame for displacement between an open position and a closed position, force-applying means rendered operative in the open position of the gate means for biasing the gate means to the closed position, releasable lock means for preventing displacement of the gate means from one of said positions to the other of said positions, and means responsive to opening pressure applied to the gate means in the open position thereof for releasing the lock means to permit closing of the gate means under the bias of the force-applying means, said lock means including a lock rod connected to the gate means, a pair of one-way gripper elements engageable with said lock rod, means biasing said gripper elements into engagement with said lock rod for respectively preventing displacement of the lock rod in opposite directions, means spacing said gripper elements along the lock rod for alternately positioning them in locked and released positions relative to the lock rod, and means pivotally mounting one of the gripper elements on the frame for pivotal displacement between the locked and released positions, the other of the gripper elements being floatingly mounted on the lock rod.

4. The combination of claim 3, wherein said gate means includes a pair of gate posts pivotally mounted on the frame, said force-applying means including an actuating lever pivotally mounted on the frame, a pair of links connecting the lever to the gate posts, respectively, and spring means elastically deformed in response to displacement of the gate posts to the open position by the lever for exerting said closing bias on the gate means.

5. The combination of claim 4, wherein said lock rod is pivotally connected to one of the gate posts.

6. An automatic headgate for animals, comprising a rigid frame, a pair of stanchion posts movably mounted on the frame for simultaneous movement between open and closed positions, actuator means operatively connected to the posts for displacement thereof to the open position, means rendered operative in the open position of the posts for biasing the posts to the closed position, and a pair of one-way locking devices for alternatively holding the gate posts against movement to the open and closed positions, respectively, one of the locking devices being selectively releasable to permit displacement of the posts to the open position by the actuator means, the other of the locking devices being automatically released in response to opening pressure applied to the posts in the open position.

7. The combination of claim 6, wherein said locking devices include a pair of gripper elements, and a common lock rod connected to one of the posts and engageable with said gripper elements.

8. The combination of claim 7, wherein said locking devices further include means pivotally mounting one of the gripper elements on the frame, the other of the gripper elements being floatingly mounted on the common lock rod, and spring means biasing the gripper elements into one-way locking engagement with the lock rod.

9. The combination of claim 8, including means spacing the gripper elements along the common lock rod for holding one of the elements in a release position relative to the lock rod while the other of the elements is engaged therewith under the bias of said spring means.

* * * * *